US008042230B2

(12) United States Patent
Wang

(10) Patent No.: US 8,042,230 B2
(45) Date of Patent: Oct. 25, 2011

(54) HINGE ASSEMBLY

(75) Inventor: Jin-Xin Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 403 days.

(21) Appl. No.: 12/348,415

(22) Filed: Jan. 5, 2009

(65) Prior Publication Data

US 2010/0088852 A1 Apr. 15, 2010

(30) Foreign Application Priority Data

Oct. 14, 2008 (CN) ..... 2008 1 0304910

(51) Int. Cl.
*E05C 17/64* (2006.01)

(52) U.S. Cl. ..... 16/340; 16/386

(58) Field of Classification Search ..... 16/340, 16/386, 321, 342; 361/679.27; 455/575.3; 379/433.13

See application file for complete search history.

(56) References Cited

U.S. PATENT DOCUMENTS

| | | | | |
|---|---|---|---|---|
| 5,913,351 | A * | 6/1999 | Miura | 16/340 |
| 6,065,187 | A * | 5/2000 | Mischenko | 16/341 |
| 6,286,187 | B1 * | 9/2001 | Chang | 16/340 |
| 6,481,057 | B2 * | 11/2002 | Lin | 16/340 |
| 6,647,593 | B2 * | 11/2003 | Iguchi et al. | 16/386 |
| 6,654,985 | B1 * | 12/2003 | Lu | 16/342 |
| 6,779,234 | B1 * | 8/2004 | Lu et al. | 16/340 |
| 7,117,563 | B2 * | 10/2006 | Chen et al. | 16/330 |
| 2006/0137142 | A1 * | 6/2006 | Qin et al. | 16/342 |
| 2009/0237871 | A1 * | 9/2009 | Shi et al. | 361/679.01 |
| 2010/0024171 | A1 * | 2/2010 | Wang | 16/386 |
| 2011/0041289 | A1 * | 2/2011 | Shen | 16/342 |
| 2011/0056048 | A1 * | 3/2011 | Shen | 16/342 |

* cited by examiner

*Primary Examiner* — William L. Miller
(74) *Attorney, Agent, or Firm* — Altis Law Group, Inc.

(57) ABSTRACT

A hinge assembly includes a shaft, a first bracket, a resilient member, and an engaging member. The shaft includes a limiting structure including a guiding groove and a limiting slot. The first bracket is rotatable relative to the shaft. The engaging member is rotatably sleeved on the shaft and non-rotatable relative to the first bracket. The engaging member forms a latching pole slidably received in the guiding groove and being engagable with the limiting slot of the shaft.

10 Claims, 4 Drawing Sheets

HINGE ASSEMBLY

BACKGROUND

1. Field of the Invention

The present disclosure generally relates to hinge assemblies and, particularly, to a hinge assembly used in a foldable electronic device having a top cover and a main body.

2. Description of the Related Art

Foldable electronic devices, such as notebook computers, are popular for their portability. In the foldable electronic device, a cover is rotatably connected to a main body via a typical hinge assembly.

The typical hinge assembly often includes a fixed bracket, a rotary bracket rotatable relative to the fixed bracket, an elastic member, a plurality of friction washers, a fixed member fixed to the fixed bracket, a rotary member fixed to the rotary bracket, and a shaft running through the above components. The fixed member forms a plurality of protrusions on an end surface, and the rotary member defines a plurality of slots on an end surface. When the protrusions engage with the slots, the rotary bracket can be positioned in desired positions relative to the fixed bracket.

However, two elements, the rotary member and the fixed member, are needed in the hinge assembly to position the rotary bracket in the desired positions, thus the manufacturing cost of the hinge assembly is high. In addition, the rotary member and fixed member of the hinge assembly occupies a larger space.

Therefore, a new hinge assembly is desired to overcome the above-described shortcomings.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION OF THE EMBODIMENTS

Figure 1:
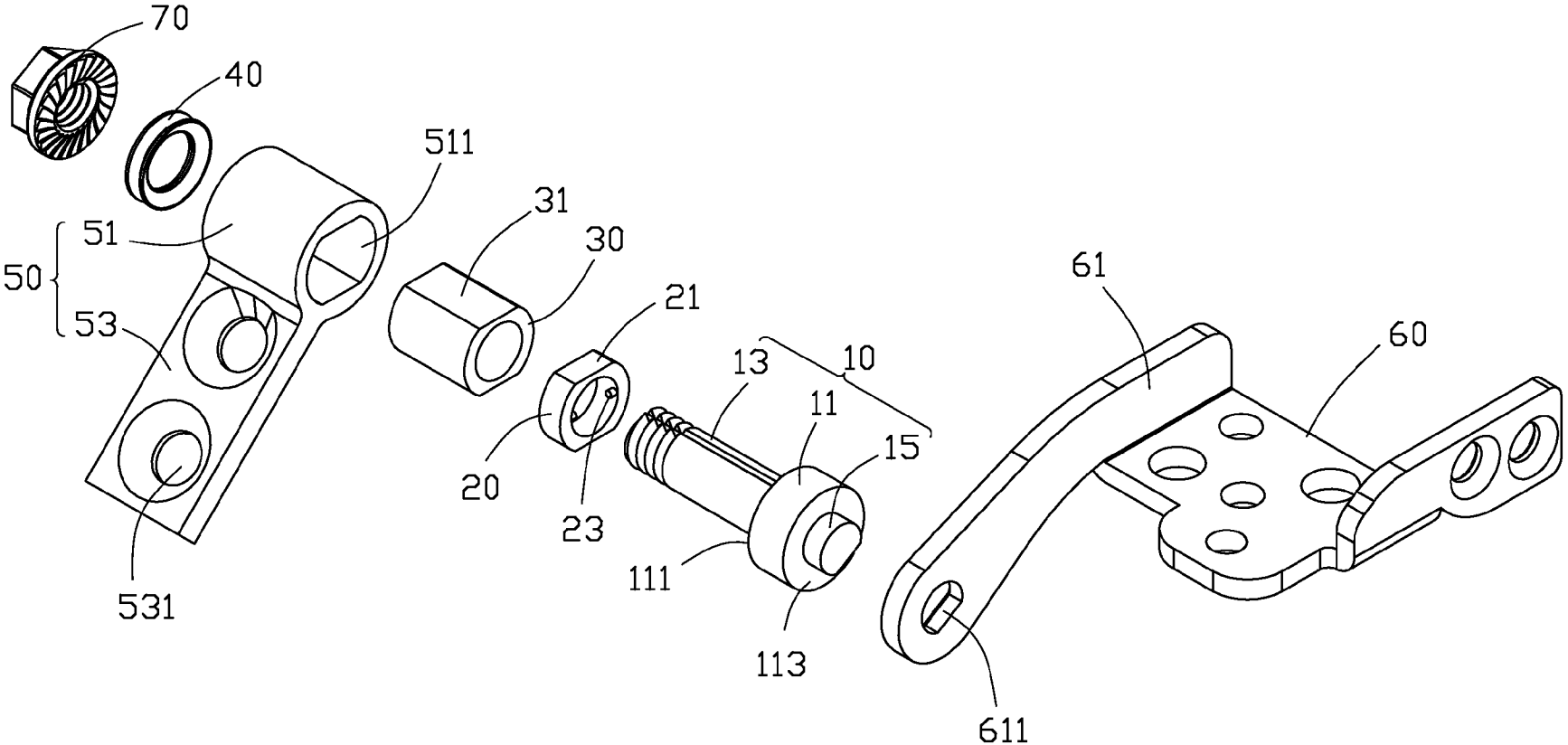
FIG. 1 is an exploded, isometric view of one embodiment of a hinge assembly.
Figure 2:
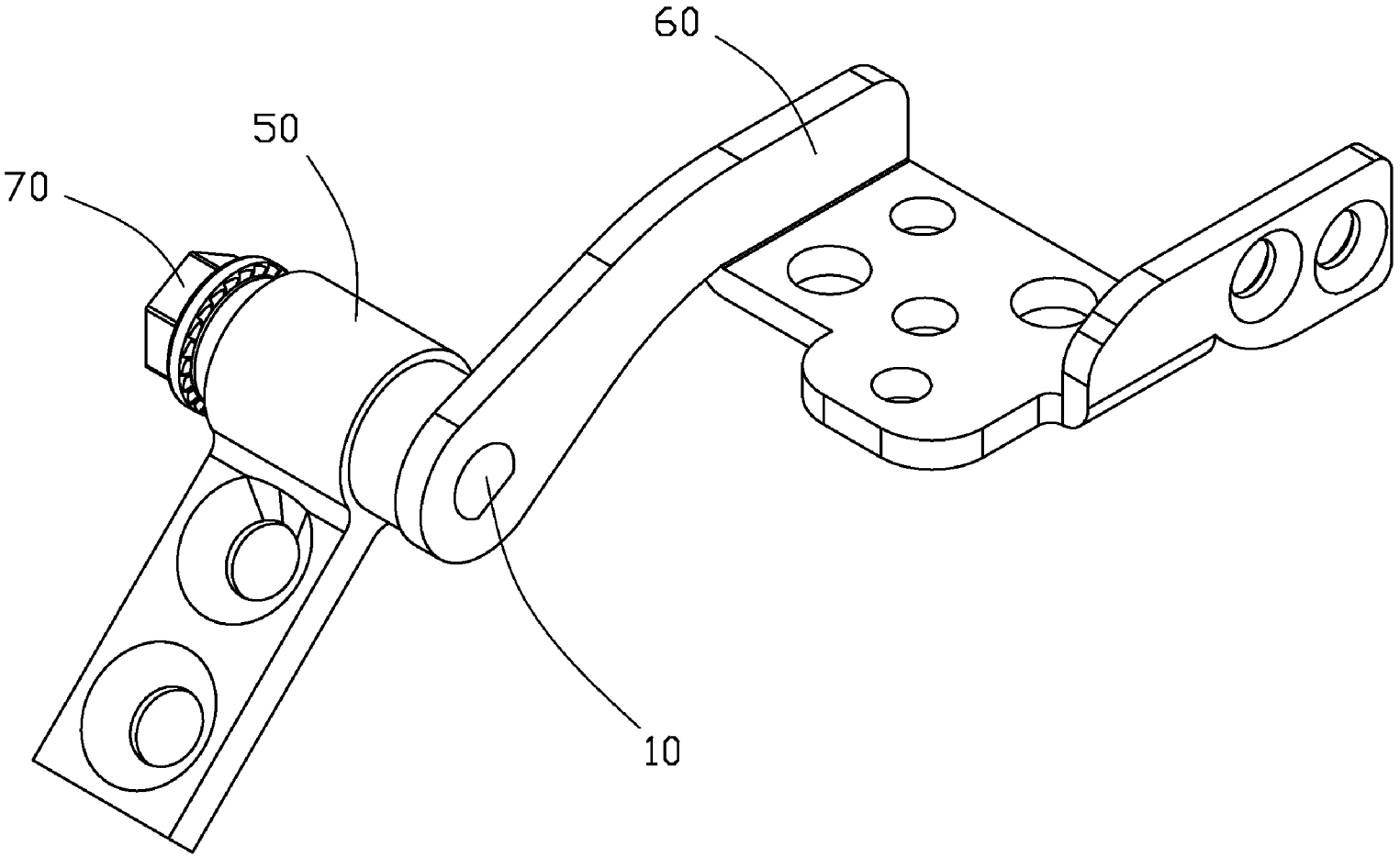
FIG. 2 is an assembled, isometric view of the hinge assembly of FIG. 1.

The present embodiments may be used in foldable electronic devices, such as notebook computers, cell phones, media players, and so on. Referring to FIGS. 1 and 2, one embodiment of a hinge assembly includes a shaft 10, an engaging member 20, a spacer 30, a resilient member 40, a first bracket 50, a second bracket 60, and a fastening member 70.

Figure 3:
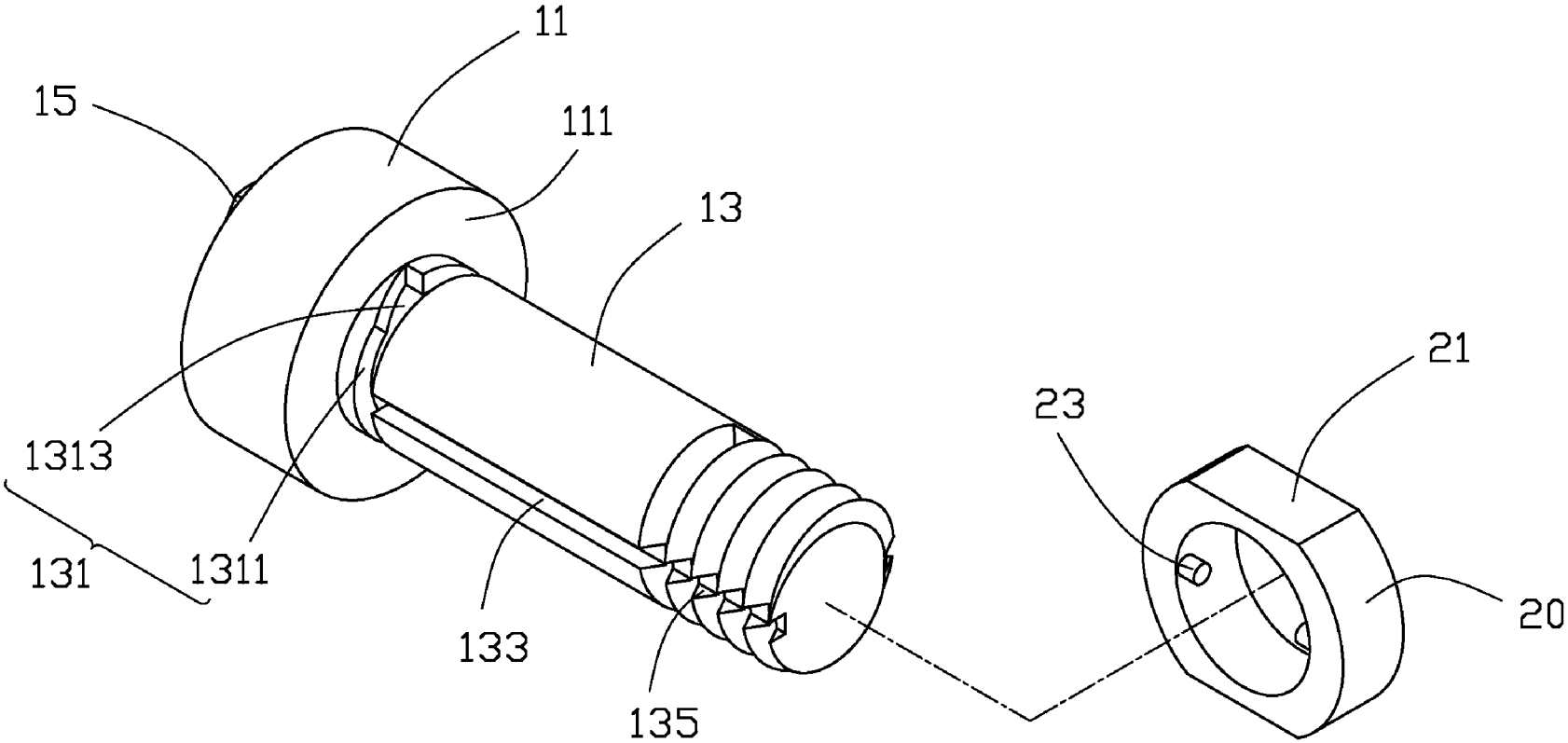
FIG. 3 is an isometric view of a shaft and an engaging member of the hinge assembly of FIG. 1.

The shaft 10 includes a cap 11, a shaft portion 13, and a connecting portion 15. Referring also to FIG. 3, the cap 11 has a first end surface 111 and a second end surface 113 opposite to the first end surface 111. The shaft portion 13 extends from the first end surface 111 of the cap 11, and the connecting portion 15 extends from the second end surface 113 of the cap 11. The shaft portion 13 includes a limiting structure 131 adjacent to the cap 11, a guiding portion 133, and a threaded portion 135. The limiting structure 131 includes a guiding groove 1311 and two limiting slots 1313 extending towards the first end surface 111. A sidewall defining the limiting slot 1313 is a slanted surface. The guiding groove 1311 is a circular groove 1311 defined in a cylindrical surface of the shaft portion 13. The guiding portion 133 includes two lengthways slots defined in the cylindrical surface of the shaft portion 13 and substantially parallel to the axis of the shaft portion 13. The threaded portion 135 is defined in an end of the shaft portion 13 away from the cap 11. The connecting portion 15 has a non-circular cross-section.

Figure 4:
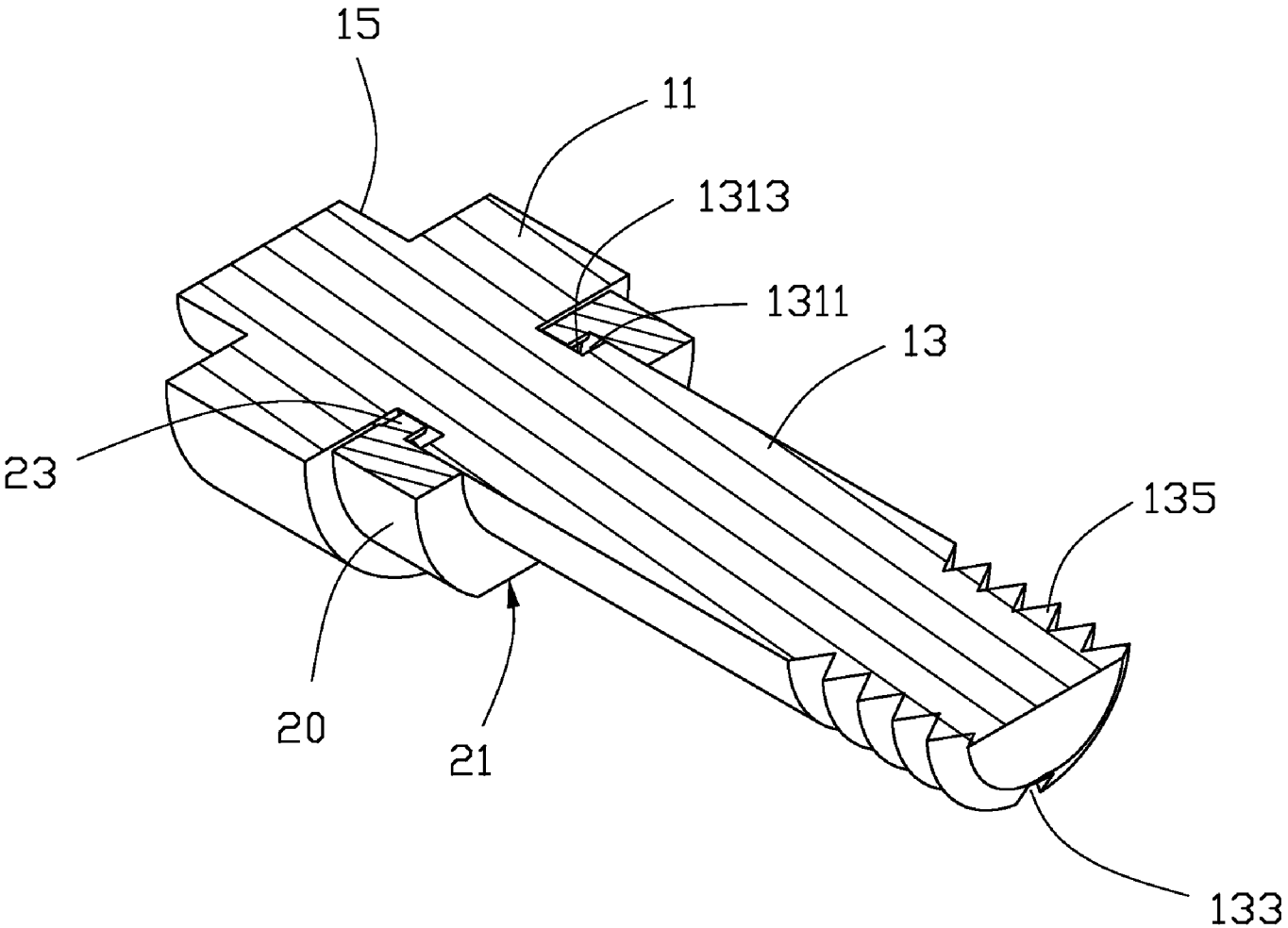
FIG. 4 is a cross-sectional view of the shaft and the engaging member, showing the shaft and the engaging member engaged with each other.

Referring to FIGS. 1 and 4, the engaging member 20 may be substantially ring-shaped. The engaging member 20 includes two opposite flattened surfaces 21 at an outer sidewall and two opposite latching poles 23 formed on an inner sidewall.

The spacer 30 may be a tube including two opposite flattened surfaces 31. The resilient member 40 surrounds the shaft 10 and provides an axial force. For example, the resilient member 40 may be an elastic washer or a columnar, compression spring. In the illuminated embodiment, the resilient member 40 is a plurality of elastic washers.

The first bracket 50 includes a pivot portion 51 and a connecting sheet 53 formed from an outer sidewall of the pivot portion 51. The pivot portion 51 may be a hollow cylinder defining a non-circular receptacle 511. The engaging member 20 and the spacer 30 are non-rotatably received in the receptacle 511. The connecting sheet 53 defines at least one connecting hole 531 configured for fixing the first bracket 50 to a cover of an electronic device.

The second bracket 60 includes a pivot sheet 61. The pivot sheet 61 defines a non-circular engaging hole 611. The engaging hole 611 has a shape corresponding to a cross-section of the connecting portion 15 of the shaft 10, so that the shaft 10 can non-rotatably connect to the second bracket 60. The second bracket 60 is configured to be fixed to a main body of the electronic device.

The fastening member 70 may be a nut. The fastening member 70 engages with the threaded portion 135 of the shaft 10.

The engaging member 20 and the spacer 30 are rotatably sleeved on the shaft portion 13 of the shaft 10. The latching poles 23 of the engaging member 20 are slid in the guiding portions 133 of the shaft 10, and into the guiding groove 1311. The latching poles 23 are slidable in the guiding groove 1311 between the limiting slots 1313, such that the engaging member 20 is rotatable relative to the shaft 10. The first bracket 50 is non-rotatably sleeved on the engaging member 20 and the spacer 30. The resilient member 40 is sleeved on the shaft portion 13 of the shaft 10 and the fastening member 70 is screwed on the threaded portion 135 of the shaft 10. The resilient member 40 resists the spacer 30. The connecting portion 15 of the shaft 10 is fixed in the engaging hole 611 of the second bracket 60.

Referring to FIG. 4, when an external force is applied to rotate the first bracket 50, the engaging member 20 and the spacer 30 rotate around the shaft 10. The latching poles 23 slide in the guiding groove 1311. When the latching poles 23 slide to an end portion of the guiding groove 1311 adjacent to the limiting slots 1313, the latching poles 23 automatically slide into the limiting slots 1313. The first bracket 50, the engaging member 20, and the spacer 30 stop rotating when the latching poles 23 engage in the limiting slots 1313, thereby positioning the first bracket 50 relative to the shaft 10 and the second bracket 60.

The first bracket 50 of the hinge assembly is positioned relative to the second bracket 60 by the limiting portion 131 of the shaft 10 and the latching poles 23 of the engaging member 20. The hinge assembly employs only a few members. Thus, the hinge assembly has low cost and occupies little space.

In alternative embodiments, the spacer 30 may be omitted. In addition, the engaging member 20 may includes only one latching pole 23, the shaft 10 may only define one guiding portion 133, and the first bracket 50 and the engaging member 20 may be integrally formed.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A hinge assembly, comprising:

a shaft comprising a shaft portion, the shaft portion comprising a guiding portion and a limiting structure formed at a distal end of the guiding portion, the limiting structure comprising a guiding groove and a limiting slot;

a first bracket rotatable relative to the shaft portion;

a resilient member rotatably sleeved on the shaft portion; and an engaging member rotatably sleeved on the shaft portion and non-rotatable relative to the first bracket, the engaging member forming a latching pole slidably received in the guiding groove and being engagable with the limiting slot of the shaft portion, wherein the guiding portion comprises a lengthways slot defined in the peripheral surface of the shaft portion and being substantially parallel to an axis of the shaft portion; and the latching pole is slidable in the lengthways slot.

2. The hinge assembly of claim 1, wherein the shaft portion defines the guiding groove and the limiting slot in a peripheral surface of the shaft portion.

3. The hinge assembly of claim 2, wherein the shaft further comprises a cap connecting with the shaft portion adjacent to the limiting structure; and the cap comprises a first end surface adjacent to the limiting structure and a second end surface opposite to the first end surface.

4. The hinge assembly of claim 3, wherein the shaft portion further comprises a threaded portion defined in an end of the shaft portion away from the cap.

5. The hinge assembly of claim 4, further comprising a fastening member to engage with the threaded portion of the shaft portion.

6. The hinge assembly of claim 3, wherein the guiding groove is a circular groove defined in a cylindrical surface of the shaft portion adjacent to the limiting structure, and the limiting slot extends towards the first end surface of the cap.

7. The hinge assembly of claim 6, wherein the limiting slot has a sidewall, and the sidewall is a slanted surface.

8. The hinge assembly of claim 1, wherein the engaging member further comprises two opposite flattened surfaces at an outer sidewall of the engaging member; the first bracket comprises a pivot portion defining a non-circular receptacle for non-rotatably receiving the engaging member; the latching pole is formed on an inner sidewall.

9. The hinge assembly of claim 8, further comprising a spacer having two opposite flattened surfaces, received in the non-circular receptacle of the first bracket.

10. The hinge assembly of claim 9, wherein the shaft further comprises a connecting portion formed at an opposite end of the cap; the hinge assembly further comprises a second bracket fixed with the connecting portion of the shaft.

* * * * *